United States Patent [19]

White

[11] 4,143,180

[45] Mar. 6, 1979

[54] ARTICLE MARKING METHOD

[75] Inventor: Paul L. White, Toledo, Ohio

[73] Assignee: Owens-Illinois, Inc., Toledo, Ohio

[21] Appl. No.: 601,751

[22] Filed: Aug. 4, 1975

[51] Int. Cl.[2] ..... B44F 1/10; G03C 11/22

[52] U.S. Cl. ..... 427/145; 427/380

[58] Field of Search ..... 252/194; 65/31; 427/145, 380

[56] References Cited

U.S. PATENT DOCUMENTS

| | | | |
|---|---|---|---|
| 2,468,402 | 4/1949 | Kreidl et al. | 65/31 |
| 3,833,406 | 9/1974 | White | 252/194 X |

*Primary Examiner*—Bernard D. Pianalto

*Attorney, Agent, or Firm*—Steve M. McLary; E. J. Holler

[57] ABSTRACT

A method for article coding using transparent indicia formed essentially of aluminum monohydrate. An article may be marked with a serial number or the like with a liquid material consisting essentially of aluminum monohydrate. When dried, the marking will be transparent. The marking will have a higher affinity for indicator solutions than will the substrate, and will therefore become visible when the article is sprayed or coated with such a solution. The article may be glass, metal, paper, wood or plastic. If the substrate material permits, heating to 300° C. after coating with the indicator solution will destroy the indicator and render the marking or indicia transparent again.

3 Claims, No Drawings

ARTICLE MARKING METHOD

BACKGROUND OF THE INVENTION

This invention generally relates to placing invisible code markings on articles. Specifically, this invention relates to such a method using aluminum monohydrate as the code marking material.

It is often desirable to mark articles with code numbers which are normally invisible. This can be for esthetic purposes to avoid serial numbers in a location which would create appearance problems. This can also be for security reasons. Television picture tube components are one example of articles which could utilize such invisible code markings. Plate or sheet glass is another example. U.S. Pat. Nos. 2,468,402 and 2,486,566 are examples of prior art transparent or invisible coatings for glass. However, these require an ultraviolet light source to render them visible. I have found that using aluminum monohydrate as the marking material gives a transparent code indicia on an article. This indicia has a greater affinity for indicator solutions, dyes or paints than does the article substrates. Thus, the indicia can be rendered visible rather easily by the spraying of the article with an indicator solution.

SUMMARY OF THE INVENTION

My invention resides in a method for article identification. In this method, the article is marked with a transparent, non-particulate coating consisting essentially of a colloidal dispersion of aluminum monohydrate, in a desired indicia pattern. Then, the transparent indicia pattern is rendered visible by contact of said indicia pattern with a suitable development material.

GENERAL DESCRIPTION OF THE INVENTION

In U.S. Pat. No. 3,833,406, I disclosed a desiccant coating composition for glass or ceramic articles. The teachings of this patent are hereby incorporated by reference. I have discovered that a very similar coating composition will allow invisible indicia, such as trademarks or serial numbers, to be placed on glass articles.

The non-particulate, thin film of the subject U.S. Patent provides a relatively large, open surface area. It therefore will absorb liquid material which is presented to it. This is in contrast to a glass or ceramic surface which will not absorb liquids. The same holds true for any non-porous surface, metals for example. In some cases, this invisible marking technique may also be used on wood, paper or plastic surfaces. However, in these cases, the material used to make the indicia visible must be carefully considered in view of the relative porosity of the substrate and the material of the film. In particular, I have found that a colloidal dispersion of aluminum monohydrate is a suitable coating material.

The following examples set forth in more detail the best mode now contemplated for carrying out the present invention.

EXAMPLE 1

A 5% residual $Al_2O_3$ dispersion was made using nitric acid as a dispersant. A transparent glass plate was lettered with a swab dipped in the dispersion using a lettering guide. The plate was then fired at about 500°C. for one-half hour. The result was a transparent film of lettering on the glass plate. The plate was then sprayed with a commercial blue indicator solution for colloidal silica. The lettered areas selectively absorbed this indicator solution and thereby became visible against the transparent glass plate. Upon heating to 300° C., the indicator solution vanished, thereby rendering the lettering once more invisible.

EXAMPLE 2

A transparent glass slide was stamped with lettering by a rubber stamp dipped in the $Al_2O_3$ dispersion of Example 1. The slide was then fired at 500° C. for about one-half hour. After cooling, the lettering was invisible when the slide was viewed perpendicular, but was faintly visible when the slide was viewed at an angle. The same slide was then lightly coated with the same $Al_2O_3$ dispersion over the lettering. The coating was mottled with a paper towel. The slide was then fixed at 400° C. for about 10 minutes. The result was a surface with a matte appearance. The lettering was not visible from any angle. When the surface was sprayed with an indicator solution for colloidal silica, the lettering became visible.

EXAMPLE 3

A 7.6% residual $Al_2O_3$ dispersion was made using acetic acid as a dispersant. A transparent glass slide was dipped in this solution and air dried after draining excess solution. The result was a transparent film on the slide. The slide was marked with the following materials: 1. Ballpoint pen; 2. Fountain pen; 3. No. 1 lead pencil; 4. Black felt tipped pen; 5. Red marking crayon. All markings were quite legible. The slide was then washed in warm water, rubbing lightly. All of the markings became illegible. The slide was then fired to 500° C. for one-half hour. All of the markings vanished when viewed perpendicular to the surface of the slide. When held at an angle, the ballpoint pen and fountain pen markings were visible.

EXAMPLE 4

A second transparent glass slide was made by the method of Example 3. This slide was fired to 500° C. for one-half hour after removal of excess material. A transparent film was formed on the slide. This slide was then marked with the five materials of Example 3. All markings were legible, with the pencil marking being somewhat less legible than in Example 3. When washed in warm water with light rubbing, all markings except the pencil marks remained legible. The slide was then fired at 500° C. for one-half hour. All of the markings vanished except for the crayon which left a white residue. The pencil, ballpoint pen, and fountain pen markings could be seen when the slide was held at an angle to the light.

EXAMPLE 5

As a control, an uncoated transparent glass slide was marked with the same five materials as in Example 3. The markings were generally legible except for the pencil markings which were very faint. When washed in warm water with light rubbing, none of the markings remained legible. All of the markings washed off except the ballpoint pen marks which were smeared and spotty. After heating to 500° C. for one-half hour, none of the markings remained.

The foregoing examples generally demonstrate that a temperature of 500° C. is satisfactory for curing the coating of aluminum monohydrate. However, tests have shown that a curing temperature as low as 300° C. may be satisfactory, although 500° C. is preferred. In addition, concentration of from 5% to 28.5% residual $Al_2O_3$ dispersions have proven acceptable. The higher concentrations usually give better contrast when coated with an indicator material. All of the various materials which can render the transparent printed indicia visible may be considered, in the most general sense, as development materials for the printed indicia. This is so since it is the purpose of these materials to render the invisible indicia visible.

What I claim is:

1. A glass article identification method which comprises the steps of:

a. marking said glass article with a transparent, non-particulate coating consisting essentially of a colloidal dispersion of aluminum monohydrate, in a desired indicia pattern;

b. heating said glass article so marked to a temperature of at least 300° C. to cure said indicia pattern; and c. contacting said transparent indicia pattern with a suitable substantially opaque development material having a greater affinity for said coating forming said indicia pattern than for said glass article to thereby render said indicia pattern visible.

2. The method of claim 1 which includes the further step of:

heating said article to a temperature above 300° C. to thereby destroy said development material and render said indicia transparent once more.

3. The method of claim 1 which includes the further steps of:

covering said indicia pattern with a thin film of the same coating material used to originally apply said indicia pattern; and heating said article to a temperature of at least 300° C.

* * * * *